US005148910A

United States Patent [19]

Williams

[11] Patent Number: 5,148,910

[45] Date of Patent: Sep. 22, 1992

[54] CIRCUIT BREAKER TAGGING/LOCKOUT APPARATUS

[75] Inventor: Danny R. Williams, Houston, Tex.

[73] Assignee: Houston Industries Incorporated, Houston, Tex.

[21] Appl. No.: 671,494

[22] Filed: Mar. 19, 1991

[51] Int. Cl.[5] ..... H01H 9/28

[52] U.S. Cl. ..... 200/43.19; 200/43.11; 200/43.14; 200/321

[58] Field of Search ..... 200/43.01, 43.11, 43.14, 200/43.15, 43.16, 43.19, 43.21, 43.17, 321, 322; 70/DIG. 30

[56] References Cited

U.S. PATENT DOCUMENTS

| | | | |
|---|---|---|---|
| 2,937,248 | 2/1959 | Michetti | 200/43.21 |
| 3,197,581 | 7/1965 | Clifford | 200/43.21 |
| 3,291,924 | 12/1966 | Tharp | 200/43.15 |
| 3,376,400 | 4/1968 | Batt et al. | 200/43.15 |
| 3,426,164 | 2/1969 | Dessert | 200/43.15 |
| 3,470,336 | 9/1969 | DeAngelo | 200/43.15 |
| 3,595,040 | 7/1971 | Curi | 200/43.15 |
| 3,678,228 | 7/1972 | Adamson | 200/43.15 |
| 4,347,412 | 8/1982 | Mihara et al. | 200/43.15 |
| 4,467,152 | 8/1984 | Gordy | 200/43.21 |
| 4,581,502 | 4/1986 | Grudzinskas | 200/43.16 |
| 4,733,029 | 3/1988 | Kobayashi et al. | 200/43.15 |
| 4,885,436 | 12/1989 | Pham et al. | 200/43.16 X |
| 4,897,515 | 1/1990 | Zubar et al. | 200/43.14 |
| 4,978,816 | 12/1990 | Costongway et al. | 200/43.15 |

FOREIGN PATENT DOCUMENTS

| | | | |
|---|---|---|---|
| 1155963 | 5/1958 | France | 200/43.21 |
| 765724 | 1/1957 | United Kingdom | 200/43.21 |
| 2152286 | 7/1985 | United Kingdom | 200/43.19 |
| 2208454 | 3/1989 | United Kingdom | 200/43.19 |

*Primary Examiner*—Charles E. Phillips
*Assistant Examiner*—Glenn T. Barrett
*Attorney, Agent, or Firm*—Pravel, Gambrell, Hewitt, Kimball & Krieger

[57] ABSTRACT

An apparatus is provided for mounting on a circuit breaker to tag or indicate that an electrical line or equipment connected to the breaker is being serviced. Once work has been completed, the apparatus can be removed from the circuit breaker for later use on other breakers. When in place on the circuit breaker, the apparatus keeps the circuit breaker switch or handle in an open or off position, while also enclosing the switch to render it inaccessible from inadvertent contact.

18 Claims, 2 Drawing Sheets

CIRCUIT BREAKER TAGGING/LOCKOUT APPARATUS

BACKGROUND OF INVENTION

1. Field of Invention

The present invention relates to tags or locks for electrical equipment, particularly circuit breakers.

2. Description of Prior Art

In servicing or working on electrical lines or power equipment, safety considerations normally dictate that live electrical power be disconnected. Typically, this is done by interrupting the electrical circuit at a circuit breaker switch. Often, the work location may be out of view or at some distance from the circuit breaker. A risk was thus presented that someone unaware that service was in progress might inadvertently reset the circuit breaker switch. Restoration of electrical power in this manner was clearly a safety hazard.

It has been proposed to provide some mechanism so that a lock could be secured to the circuit breaker to prevent movement of the circuit breaker switch from an open or off position. U.S. Pat. Nos. 3,595,040 and 4,733,029 are examples of such an approach. However, the handle lock attachments of this type were fixedly attached by securing screws or rivets to the circuit breaker housing. This necessitated that openings for the securing members be formed, such as by drilling or tapping, in the body of the circuit breaker.

U.S. Pat. No. 3,291,924 related to structure which relied on a camming action of a lock attachment mechanism against the circuit breaker switch or handle. Forces exerted by this camming action urged the relatively yieldable synthetic resin material of the circuit breaker handle into a sharp biting metal edge or barb. Service usage would thus damage the circuit breaker handle.

SUMMARY OF INVENTION

Briefly, the present invention provides a new and improved apparatus for retaining an electrical circuit breaker handle in an off position, while work is done on an electrical line or equipment connected to the circuit breaker, to indicate work is being done. The apparatus includes a protective closure which has side walls and a top plate and is mounted on the circuit breaker about the circuit breaker handle. The closure has a handle slot formed in the top plate for access to the circuit breaker handle. A contact finger is mounted on the top plate to extend into the closure adjacent the handle slot. The contact finger engages the breaker handle when the breaker handle is in the off position. A camming member is provided which is movable with respect to the closure to a handle contact position for camming the breaker handle against the contact finger when the breaker handle is in the off position. A lock member is provided which is mounted externally of the closure in order to lock the camming member in the handle contact position.

DESCRIPTION OF PREFERRED EMBODIMENT

Figure 5:
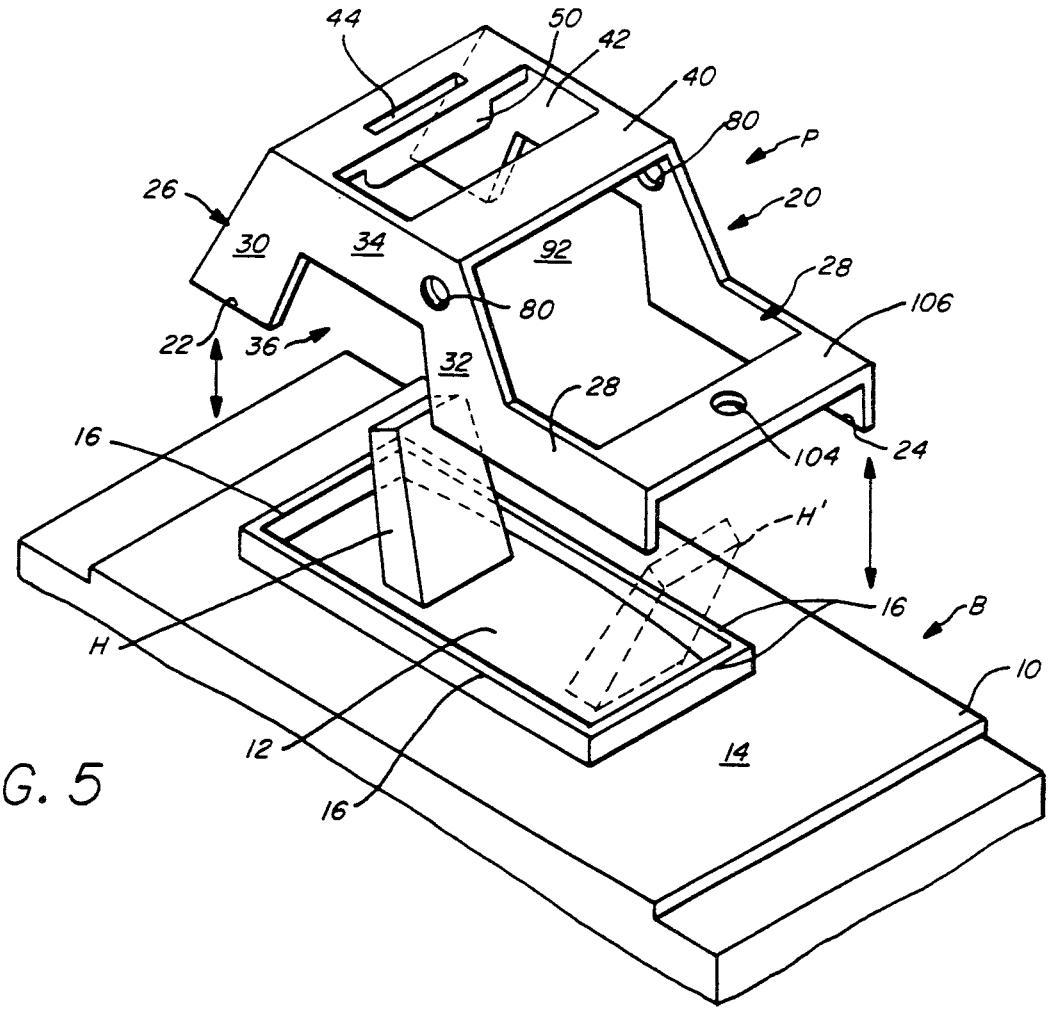
FIG. 5 is an exploded isometric view of the structure of FIG. 4.

In the drawings, the letter A designates generally an apparatus according to the present invention for use with electrical power distribution in an electrical line connected to an electric circuit breaker B. The apparatus A is used to retain an electrical circuit breaker handle or lever switch H in an off position (FIGS. 3–5) on the breaker B to interrupt the flow of electrical power while work is being done on an electrical line or equipment served by the line. The apparatus of the present invention is thus used in connection with the circuit breaker B whether electrical equipment or an electrical in circuit with the breaker B, or both, is being serviced. The apparatus A serves further to indicate that such work is being done. In this manner, inadvertent switching of the circuit breaker handle H is prevented to protect against electrical shock or injury to electrical service crews working on the electrical line or equipment. Since the apparatus A when in place indicates that the breaker B is off so that work may be done, deliberate lifting or moving forces have to be exerted to disengage the apparatus A from the breaker handle H in the off position.

As is conventional, the circuit breaker B is mounted in a breaker box or casing 10 which has a switch slot or opening 12 formed in a front face 14 within outwardly extending sidewalls 16. The circuit breaker handle H is movable to an off position (FIGS. 3–5) in the slot 12 as shown where the flow of electrical power to the electrical line or equipment connected to the circuit breaker B is interrupted. The circuit breaker handle H is also movable to an on position in the slot 12 as shown in phantom at H' (FIG. 5) which permits the flow of electrical power through the electrical line.

Figure 2:
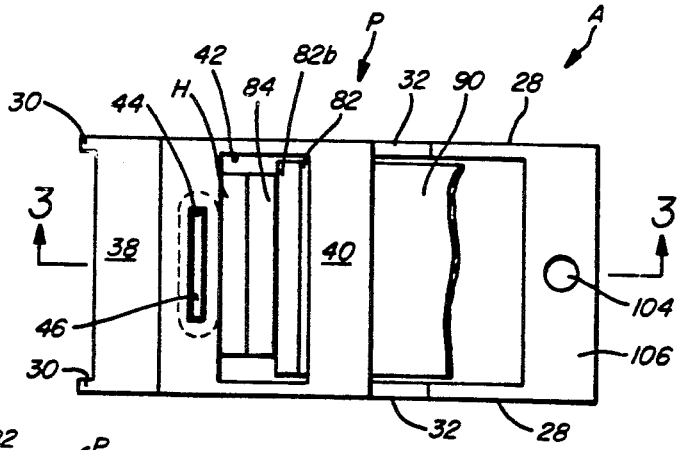
FIG. 2 is a plan view of the apparatus of FIG. 1, with portions thereof removed.

The apparatus A includes a protective closure or container P which may be formed from a synthetic resin of suitable strength. The material used for the closure P may be painted or dyed or otherwise suitably colored a suitable color to indicate its use for caution or safety purposes. The closure P has two sidewalls 20 adapted to be mounted on lower portions 22 and 24 on the front face 14 of the breaker box 10 along side the sidewalls 14 adjacent the slot 12. The sidewalls 20 of the enclosure P are generally A-shaped on a first or front end 26 and have a lower rear wall portion 28 at an opposite end. The front portions 26 of sidewalls 20 have upwardly extending frame portions 30 and 32 and a laterally extending connector beam or member 34. The frame portions 30 and 32, together with the member 34 form an access port 36 in the sidewalls 20 for access to the breaker handle H within the closure P. A front wall member 38 (FIGS. 2 & 3) extends between and connects the frame portions 30 of the sidewalls 20 at the end 26 of the closure P.

Figure 1:
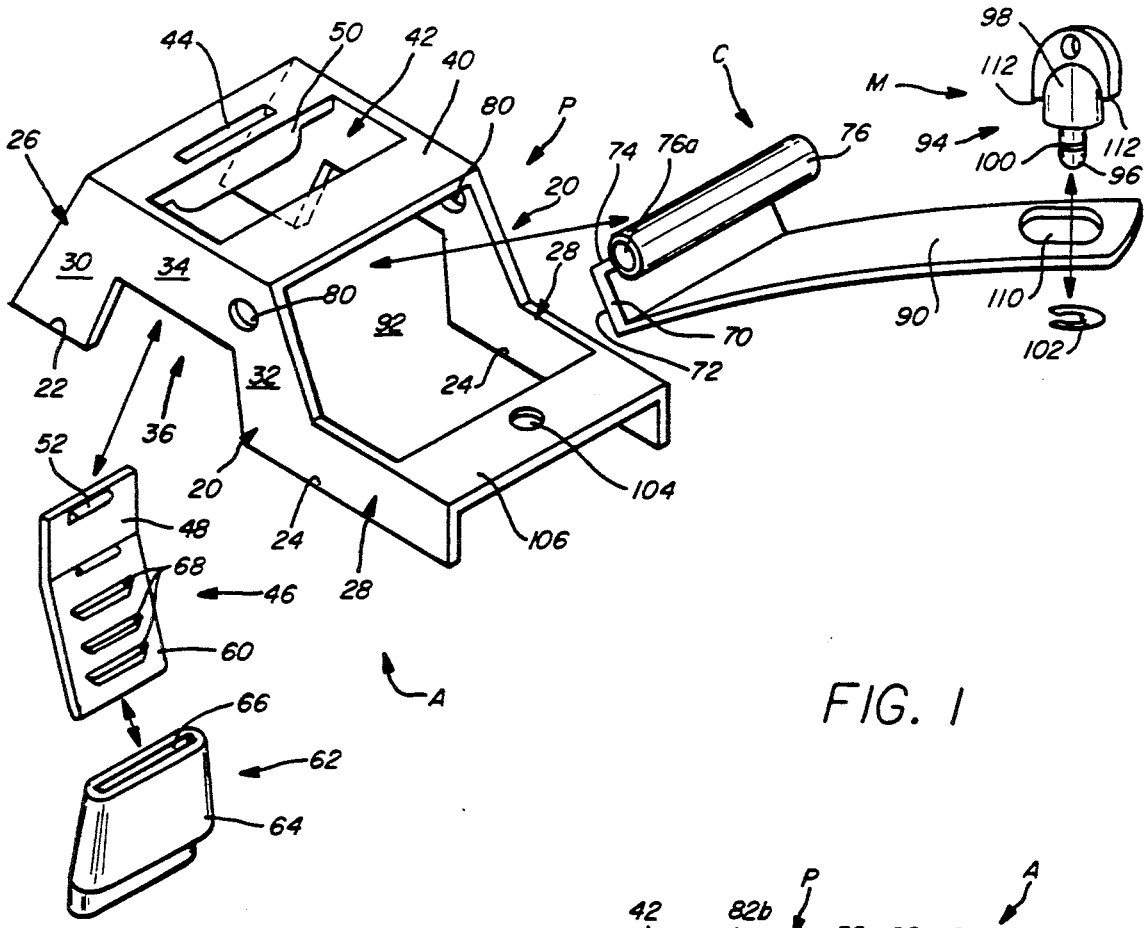
FIG. 1 is an exploded isometric view of an apparatus according to the present invention.

A top plate 40 of the closure P extends generally horizontally between the side walls 20 above the connector members 34. A laterally extending handle slot 42 is formed in the top plate 40 so that access may be provided therethrough to the circuit breaker handle H within the closure P. A laterally extending connector socket 44 is formed in the top plate 40 adjacent the handle slot 42 for mounting a contact finger member 46 (FIG. 1) with the closure P.

The contact finger member 46 extends downwardly (FIG. 3) from the top plate 40 into the closure P adjacent the handle slot 42 and is adapted to engage the breaker handle H when the breaker handle H is in the off position. The contact finger 46 includes a generally vertically extending upper connector portion 48 (FIG. 3) which fits within and extends upwardly through a connector sleeve 50. Connector sleeve 50 formed extending downwardly into the closure P about a central opening of a like size to the connector socket 44. The connector sleeve 50 also extends downwardly from the top plate 40 adjacent the handle slot 42. A mounting tab or lug 52 (FIG. 1) is formed extending laterally across the top of the upper portion 48 of the contact finger 46 and is adapted to fit within a recess 58 (FIG. 3) formed in the top plate 40 adjacent the connector socket 44.

Figure 3:
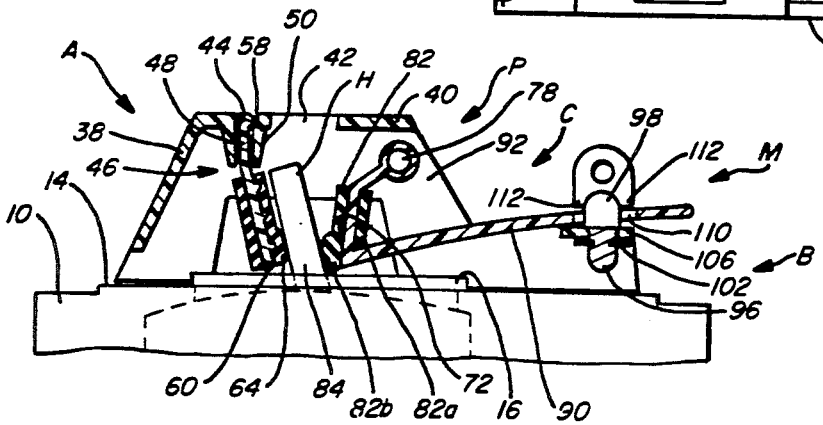
FIG. 3 is a cross-sectional view of the apparatus of FIG. 2, taken along the line 3—3 of FIG. 2.
Figure 4:
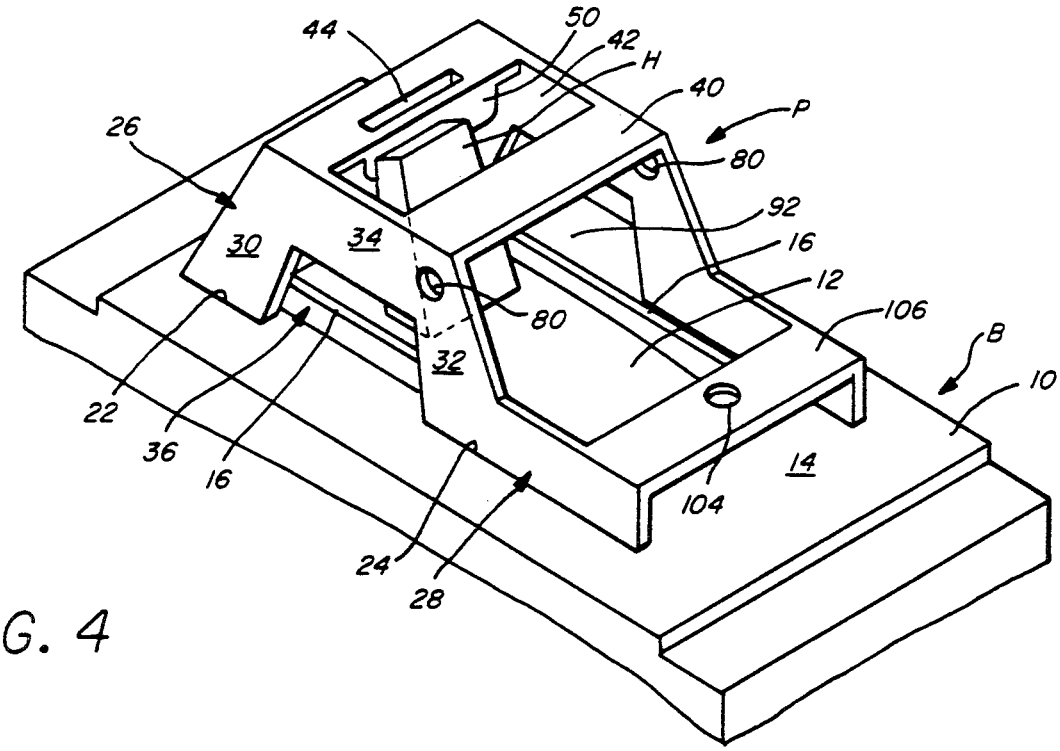
FIG. 4 is an isometric view of portions of the apparatus of FIG. 1 with an electrical circuit breaker. Portions of the apparatus of the present invention shown in FIGS. 1 and 3 are not shown in FIG. 4 so that interior portions may be more clearly seen.

The contact finger 46 further includes a lower portion 60 which extends from the upper portion 48 (FIGS. 1 & 3) at an angle which substantially conforms to the angle of the breaker handle H when the breaker handle H is in the off position (FIG. 3).

A cover padding member 62 (FIG. 1) is preferably provided and is formed of a relatively yieldable material such as rubber or a soft synthetic resin has a sleeve member 64 formed therein about a longitudinally extending slot 66 which is fitted over the lower portion 60 of the contact finger 46. Transversely extending support ribs 68 are formed on the lower portion 60 of the contact finger 46 engage and hold the cover padding member 62 in place on the contact finger 46. The contact finger 46 is formed of a resilient material, such as a suitable synthetic resin, so that the inwardly extending lower portion 60 exerts a resistive force through the cover padding 62 against that of the breaker handle H.

The apparatus A further includes camming structure C which is movable with respect to the closure P to a handle contact position (FIG. 3) for camming the breaker handle H against the contact finger 46 when the breaker handle H is in the off position. The camming member C includes a front camming plate 70 mounted beneath the top plate 40 of the closure P. The camming plate 70 has a camming face 72 formed thereon for camming the breaker handle H against the contact finger in the handle contact position.

The camming plate 70 is mounted by a connector arm 74 to a tubular pivot pin sleeve or sleeves 76 at an upper portion thereof.

The pivot pin sleeve 76 has openings **76*a* formed at each end thereof so that a connector pivot pin or rod 78 (FIG. 3) may be inserted through openings 80 formed in the member 34 to pivotally mount the camming member C with the closure P. The camming face 72 of the camming plate 70 also preferably has a cover sleeve 82 of padding material formed on it like the padding material 62 on the contact finger 46**.

The camming member 70 fits within a vertically extending slot **82*a* formed through the cover padding 82. Cover padding 82 has a lower contact shoulder 82*b* of enlarged dimensions to contact a base portion 84 of the breaker handle H and exert a retaining force urging the breaker handle H into engagement with the contact finger 46 and its associated padding cover 62**.

The camming member C also includes an outwardly extending arm or gripping tab 90 which extends rearwardly from the camming plate 70 for movement of the camming plate to and from the handle contact position (FIG. 3). A movement port 92 is formed in the closure P between the frame portions 32 of the sidewalls 20 and below the top plate 40 for passage of the gripping tab 90 through the closure P.

The apparatus A also includes a lock mechanism M which is mounted externally of the closure P for locking the camming member C in the handle contact position. The locking mechanism M includes a locking member 94 which is rotatably mounted in the gripping tab 90 at a spaced position from the camming plate 70 of the camming member C.

The lock member 94 includes a lock pin 96 extending downwardly from a lock head 98. A circumferential groove or slot 100 is formed in the lock pin 96 so that a retaining washer or disk 102 may be fitted therein. The lock pin 96 of the lock member 94 extends downwardly and is mounted within an opening 104 formed in a transversely extending connector plate 106 of the closure P formed beneath and adjacent the gripping tab 90. The retaining washer or disk 102 is fitted into the slot 100 on the lock pin 96 beneath the connector plate 106 (FIG. 3).

The lock head body member 98 extends above the lock pin 96 and is adapted for passage through an elongate elliptical slot 110 formed in the gripping tab 90. The lock head body 98 is rotatable and has an open position (FIGS. 1 and 3) where locking lugs 112 which extend outwardly from opposite sides pass through the elliptical socket 110 in the gripping tab 90. The locking head body 98 is also rotatable one-quarter turn, either clockwise or counterclockwise, from the open position to a locking position where the locking lugs 112 extend outwardly beyond the elliptical socket or slot 110 over portion of the gripping tab 90 to engage and lock the gripping tab 90 to the connector plate member 106.

In the operation of the present invention, a crew member desiring to work on an electrical line or equipment connected to the circuit breaker B first trips the lever switch or handle H to the off position. The closure P is then fitted over the breaker switch handle H with sidewalls 20 of the closure member P resting on the front face 14 of the breaker box B. The contact finger 46 thus rides against the upwardly extending handle H in the off position.

The camming member C is then pivoted downwardly so that the camming face 72 moves forward and urges the padding cover 82 mounted thereon against the breaker switch handle H. With the camming member C moving into this locking head 98 extends upwardly through the socket 110 in the gripping tab 90. The locking head 98 is then rotated one-quarter turn so that the locking lugs 112 extend outwardly from the socket 110 and rest upon the rear arm of the gripping tab 90. In this position, locking mechanism M locks the camming member C into locking position, holding the breaker switch H firmly in the off position between the contact finger 46 and the camming member C.

As has been set forth above, deliberate lifting force would have to be exerted on the apparatus A to disengage the apparatus A from a position gripping the breaker handle H in the off position. In this manner, the apparatus A retains the electrical circuit breaker H in the off position while work is being done on electrical circuitry of equipment or lines connected to the circuit breaker B. Further, as has been set forth, the apparatus A indicates that service work is being done on the line connected to the breaker B for safety and protective purposes.

Having described the invention above, various modifications of the techniques, procedures, material and equipment will be apparent to those in the art. It is intended that all such variations within the scope and spirit of the appended claims be embraced thereby.

I claim:

1. An apparatus for use with an electrical circuit breaker for retaining a handle of the circuit breaker in an off position while work is done on an electrical line or equipment connected to the circuit breaker to indicate work is being done, comprising:

a protective closure having side walls and a top plate for mounting on the circuit breaker about the circuit breaker handle;

said closure having a handle slot formed in said top plate for access to the circuit breaker handle;

a contact finger mounted on said top plate and extending into said closure adjacent said handle slot for engaging the breaker handle when the breaker handle is in the off position;

camming means movable with respect to said closure to a handle contact position for camming the breaker handle against said contact finger when the breaker handle is in the off position, said camming means comprising:

a camming plate mounted beneath said top plate of said closure and having a camming face for camming the breaker handle in the handle contact position;

means mounting said camming plate for pivotal movement to the handle contact position; and lock means mounted externally of said closure for locking said camming means in the handle contact position.

2. The apparatus of claim 1, wherein said means mounting said camming plate comprises:

pivot pin means mounted in said side walls of said closure; and a pivot pin sleeve mounted with said camming plate for receipt of said pivot pin means.

3. The apparatus of claim 1, wherein said camming means further includes:

a padding member mounted on said camming plate for transferring force from said camming plate to the breaker handle.

4. The apparatus of claim 1, wherein said camming means further includes:

a gripping tab extending rearwardly from said camming plate for movement of said camming plate to and from the handle contact position.

5. The apparatus of claim 4, further including:

a movement port formed in said closure for passage of said gripping tab therethrough.

6. The apparatus of claim 4, wherein said lock means comprises:

a lock member rotatably mounted with said gripping tab at a spaced position from said camming face.

7. The apparatus of claim 6, wherein:

said lock member includes a lock pin.

8. The apparatus of claim 7, further including:

a connector plate member formed on said closure adjacent said gripping tab;

said connector plate member having an opening therein for passage of said lock pin therethrough; and means mounting said lock pin in said opening in said connector plate.

9. The apparatus of claim 8, wherein:

said lock member includes a lock head extending upwardly from said lock pin; and said gripping tab has a slot formed therein for passage of said lock head therethrough.

10. The apparatus of claim 9, wherein said lock head comprises:

a lock head body for passage through said slot in said gripping tab and rotatable between an open and a closed position; and locking lugs extending outwardly from said lock head body on opposite sides thereof;

said locking lugs extending outwardly beyond said slot in said gripping tag to lock said gripping tab to said connector plate member when said lock head body is in the closed position.

11. An apparatus for use with an electrical circuit breaker for retaining a handle of the circuit breaker in an off position while work is done on an electrical line or equipment connected to the circuit breaker to indicate work is being done, comprising:

a protective closure having side walls and a top plate for mounting on the circuit breaker about the circuit breaker handle;

said closure having a handle slot formed in said top plate for access to the circuit breaker handle;

a contact finger mounted on said top plate and extending into said closure adjacent said handle slot for engaging the breaker handle when the breaker is in the off position;

camming means movable with respect to said closure to a handle contact position for camming the breaker handle against said contact finger when the breaker handle is in the off position;

lock means mounted externally of said closure for locking said camming means in the handle contact position; and a connector socket formed in said top plate of said closure adjacent said handle slot for mounting said contact finger to said closure.

12. The apparatus of claim 11, further including:

a connector sleeve extending downwardly from said connector socket and said top plate into said closure.

13. The apparatus of claim 12, wherein said contact finger includes:

an upper portion mounted in said connector sleeve; and a lower portion extending from said connector sleeve for engaging the breaker handle.

14. An apparatus for retaining an electrical circuit breaker handle in an off position while work is done on an electrical line or equipment connected to the circuit breaker to indicate work is being done, comprising:

a protective closure having side walls and a top plate for mounting on the circuit breaker about the circuit breaker handle;

said closure having a handle slot formed in said top plate for access to the circuit breaker handle;

a contact finger mounted on said top plate and extending into said closure adjacent said handle slot for engaging the breaker handle when the breaker handle is in the off position;

camming means movable with respect to said closure to a handle contact position for camming the breaker handle against said contact finger when the breaker handle is in the off position;

lock means mounted externally of said closure for locking said camming means in the handle contact position; and a padding member mounted on said contact finger for transferring force between said contact finger and the breaker handle.

15. An apparatus for retaining an electrical circuit breaker handle in an off position while work is done on an electrical line or equipment connected to the circuit breaker to indicate work is being done, comprising:

a protective closure having side wall and a top plate for mounting on the circuit breaker about the circuit breaker handle;

said closure having a handle slot formed in said top plate for access to the circuit breaker handle;

a contact finger mounted on said top plate and extending into said closure adjacent said handle slot for engaging the breaker handle when the breaker handle is in the off position, said contact finger including:

an upper portion extending downwardly from said top plate into said closure;

a lower portion extending from said upper portion at an angle substantially conforming to the breaker handle when the breaker handle is in the off position;

camming means movable with respect to said closure to a handle contact position for camming the breaker handle against said contact finger when the breaker handle is in the off position; and lock means mounted externally of said closure for locking said camming means in the handle contact position.

16. The apparatus of claim 15, further including:

a padding member mounted on said contact finger for transferring force between said contact finger and the breaker handle.

17. The apparatus of claim 16, wherein said contact member includes:

support ribs formed on said lower portion of said contact finger for holding said padding member in place on said contact finger.

18. An apparatus for retaining an electrical circuit breaker handle in an off position while work is done on an electrical line or equipment connected to the circuit breaker to indicate work is being done, comprising:

a protective closure having side walls and a top plate for mounting on the circuit breaker about the circuit breaker handle;

said closure having a handle slot formed in said top plate for access to the circuit breaker handle;

a contact finger mounted on said top plate and extending into said closure adjacent said handle slot for engaging the breaker handle when the breaker handle is in the off position;

camming means movable with respect to said closure to a handle contact position for camming the breaker handle against said contact finger when the breaker handle is in the off position;

lock means mounted externally of said closure for locking said camming means in the handle contact position; and access ports formed in said side walls of said closure for access to the breaker handle.

* * * * *

UNITED STATES PATENT AND TRADEMARK OFFICE

CERTIFICATE OF CORRECTION

PATENT NO. : 5,148,910

DATED : 9/22/92

INVENTOR(S) : DANNY R. WILLIAMS

It is certified that error appears in the above-identified patent and that said Letters Patent is hereby corrected as shown below:

Col. 4, line 51, after "this" insert --position (Fig. 3), the".

Signed and Sealed this

Twenty-eighth Day of September, 1993

Bruce Lehman

*Attest:*

BRUCE LEHMAN

*Attesting Officer*

*Commissioner of Patents and Trademarks*